US006957134B2

(12) United States Patent
Ramseyer et al.

(10) Patent No.: US 6,957,134 B2
(45) Date of Patent: Oct. 18, 2005

(54) METHOD OF TESTING A VEHICLE AUDIO SYSTEM USING A COMPOSITE SIGNAL

(75) Inventors: Robert Ramseyer, Farmington, MI (US); Douglas Plumb, Toronto (CA)

(73) Assignee: B & G L.L.C., Sterling Heights, MI (US)

( * ) Notice: Subject to any disclaimer, the term of this patent is extended or adjusted under 35 U.S.C. 154(b) by 0 days.

(21) Appl. No.: 10/763,615

(22) Filed: Jan. 23, 2004

(65) Prior Publication Data

US 2004/0153224 A1 Aug. 5, 2004

Related U.S. Application Data

(60) Provisional application No. 60/442,137, filed on Jan. 23, 2003.

(51) Int. Cl.[7] ..... H04R 29/00

(52) U.S. Cl. ..... 701/29; 701/36; 455/99; 455/67.11; 381/58; 381/59; 381/86

(58) Field of Search ..... 701/1, 22, 29, 701/36; 381/58, 59, 86, 98; 455/66, 67.11, 455/67, 66.1, 67.14, 99; 340/514, 515

(56) References Cited

U.S. PATENT DOCUMENTS 5,042,070 A * 8/1991 Linna et al. ..... 381/59
5,108,335 A * 4/1992 Carey et al. ..... 455/345
5,164,703 A * 11/1992 Rickman ..... 340/515
5,361,305 A 11/1994 Easley et al. ..... 381/58
5,361,306 A * 11/1994 Garcia ..... 381/98

* cited by examiner

*Primary Examiner*—Richard M. Camby
(74) *Attorney, Agent, or Firm*—Gifford, Krass, Groh, Sprinkle, Anderson & Citkowski, PC

(57) ABSTRACT

The present invention provides a method for evaluating the presence and performance of a vehicle's audio system drivers without the need for having to manually or remotely control the audio system parameters during the testing period. After establishing baseline characteristics for a driver group to be evaluated, a predetermined broadcast signal is used to excite a particular subgroup of drivers within the driver group. The output from the subgroup of driver drivers is detected by microphones strategically disposed within the vehicle amongst the group of drivers. The detected output from the driver drivers is thereafter decoded and analyzed with respect to the baseline performance to determine if the drivers are performing within expected specifications.

14 Claims, 2 Drawing Sheets

METHOD OF TESTING A VEHICLE AUDIO SYSTEM USING A COMPOSITE SIGNAL

RELATED APPLICATION

This application claims priority of U.S. Provisional Patent Application Ser. No. 60/442,137 filed Jan. 23, 2003, which is incorporated herein by reference.

FIELD OF THE INVENTION

The present invention relates to testing a vehicle's audio system and more particularly to a method for testing the vehicle audio system drivers during a vehicle assembly process that obviates the need for making adjustments to audio system parameters during the test.

BACKGROUND OF THE INVENTION

Existing methods for reliably testing the presence and performance of a vehicle's audio system speakers or drivers during the vehicle assembly process typically rely on remotely controlling the mode and fade/balance settings of the radio outputs such that each of the audio system drivers may be evaluated. U.S. Pat. No. 5,361,305 discloses an automated system and method for automotive audio testing wherein a computer control system is coupled to the vehicle's data bus via a diagnostic connector. The computer is used to control the radio parameters as well as an RF generator that is operative to broadcast predetermined tones which are coupled to the radio antenna base. A microphone is used in the vehicle to detect tones from the radio drivers and a decoder analyzes the tones to determine whether the tone is correct according to a predetermined baseline. A computer program is used to select certain drivers for testing by remotely adjusting the fade and balance controls accordingly until all drivers have been tested.

Although the '305 patent presents a method of testing a vehicle's audio system that obviates the need for having an operator manually control the radio to test the performance of the audio system and drivers, the invention is only applicable for use with an audio system which is operative to be coupled to a vehicle data bus whereby certain parameters may be controlled remotely via a computer system.

The present invention seeks to provide a method of testing a vehicle audio system that does not require manual or automatic adjustment of the audio system parameters during testing such that systems not designed to be remotely controlled via the vehicle's data bus may be tested in a reliable and efficient manner.

SUMMARY OF THE INVENTION

The present invention provides a method in which the speakers, or drivers, of a vehicle audio system can be efficiently and reliably evaluated by utilizing a composite broadcast signal and filtering to evaluate the operation of a driver group over a sampling period. The method can be performed automatically thus obviating the need to remotely control the radio via the vehicle data bus or manually. Initially, the method for determining the performance of a vehicle's audio system drivers as according to the invention requires that predetermined baselines be established for each particular driver of a driver group intended to be disposed in the vehicle. This is done by driving each driver of the driver group with an audio signal that varies in frequency over time. The driver's output or response to the audio signal is commonly referred to as its frequency response. A baseline for a particular type of driver in a driver group may be established by averaging the frequency responses from a number of drivers of a particular type and thereafter determining a performance tolerance value to be used in conjunction with the baseline.

After baselines have been determined for each type of driver in a driver group, the testing begins by presetting the vehicle's audio system to a predetermined station, preferably an FM station. Then the audio system's output is preset to be balanced and centered among the system drivers. Each of these presetting steps is performed manually.

Next an RF signal is broadcast to the vehicle's audio system for exciting at least one of the system drivers. The RF signal may be broadcast in monotone, stereo left or stereo right as desired for exciting particular drivers.

The output from each of the system drivers is detected using an audio detection device such as a microphone. Thereafter, the output signal is decoded and analyzed with respect to the predetermined baselines for each type of driver in the driver group. In this manner, a method for determining the performance of a vehicle audio system may be determined by adjusting the RF broadcast signal rather than adjusting the audio system parameters as according to conventional methods that require manual or remote adjustment of the audio system parameters via the vehicle data bus.

BRIEF DESCRIPTION OF THE DRAWINGS

The present invention will be better understood by reference to the following detailed description when read in conjunction with the accompanying drawings in which like reference characters refer to like parts throughout the several views and in which.

DETAILED DESCRIPTION OF THE INVENTION

The present invention provides a method of evaluating the performance of a vehicle's audio system drivers that obviates the need for having to manually or remotely control audio system parameters during testing. Accordingly, the invention provides a means for evaluating the performance of the drivers of any vehicle audio system including those operative to be remotely controlled via the vehicle data bus coupled to the diagnostic connector.

Figure 1:
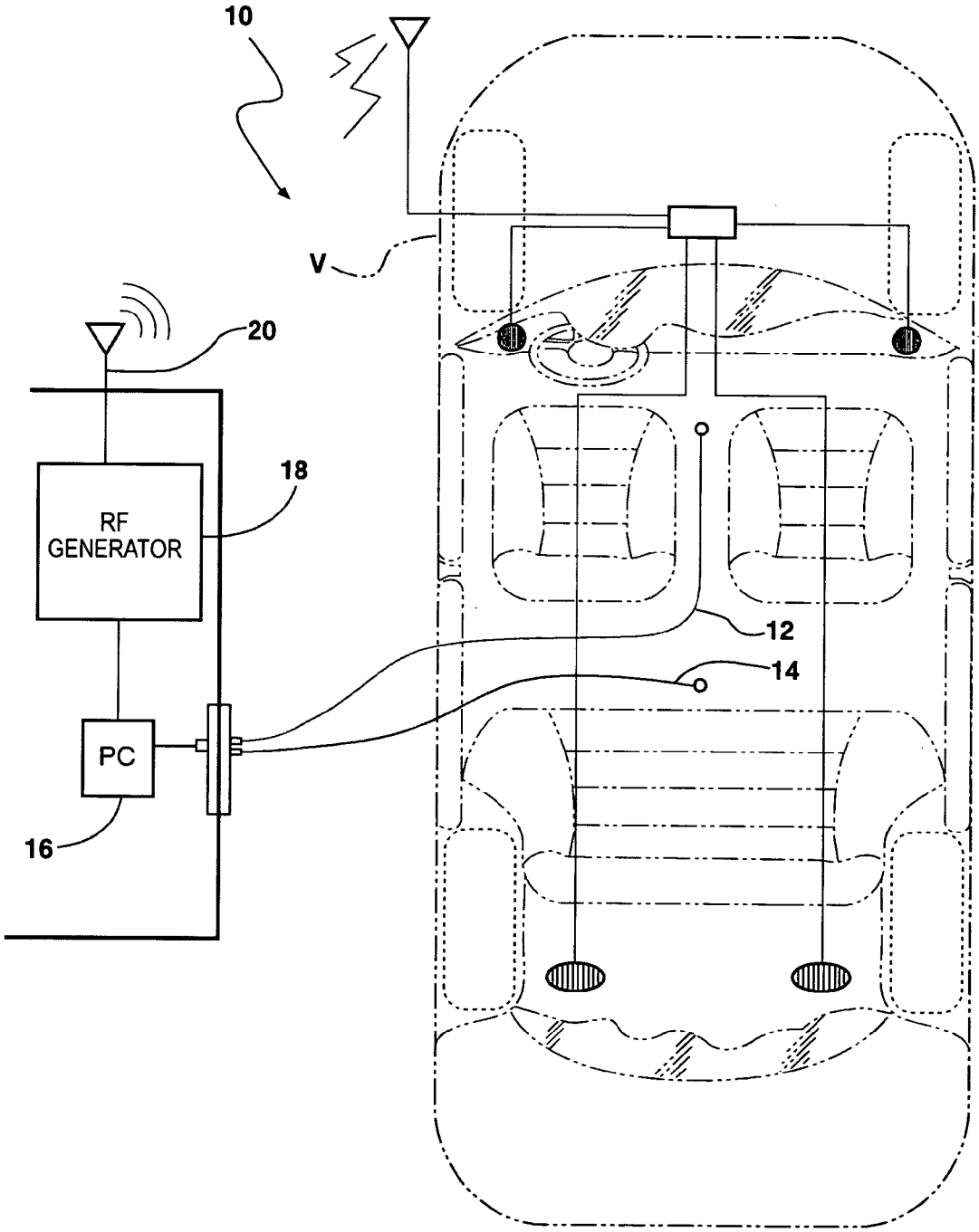
FIG. 1 illustrates a flowchart that describes the method for testing a vehicle audio system using a composite signal as according to the invention.

With reference to FIG. 1, a first step of the inventive method for testing a vehicle audio system using a composite signal includes establishing a baseline for each of the vehicle audio system drivers at 100. It is appreciated that establishing the baselines for each driver in a particular driver group may entail sampling the driver outputs from a plurality of vehicles such that the respective results taken from each vehicle may be summed and averaged to obtain a more global representation of the operation of a particular driver or driver group within a particular vehicle cabinet. In view of variations from the sample group, tolerance values for performance may also be established and included as part of the baseline performance for each driver in the driver group.

After establishing the baselines for each of the system drivers, testing may begin.

Before actual testing of the audio system drivers disposed within the vehicle, the radio is preset such that it is tuned to a particular station and the audio output to the system drivers is set to be balanced and centered 110. As the present method for evaluating the driver performance may be used for any audio system, including those having the capability of being remotely controlled via the vehicle data bus, the presets may be accomplished manually or remotely if available. Preferably, the radio is set to a predetermined FM station that is known to have good reception for maximizing audio signal output from the drivers. It is appreciated that the preset settings prior to each test are identical to those settings used in establishing the baseline characteristics of the driver group to ensure the veracity and reliability of the test results.

Figure 2:
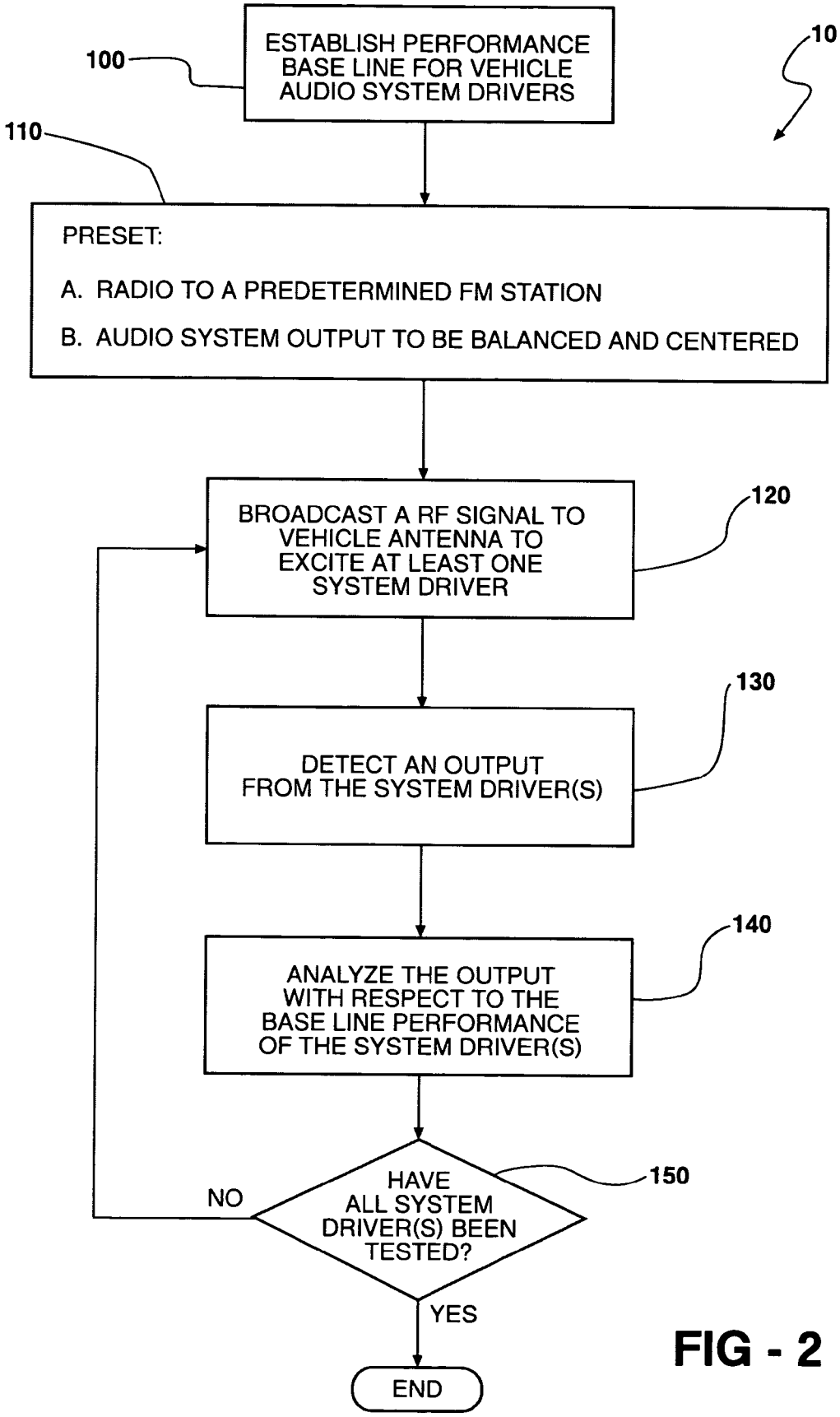
FIG. 2 illustrates a block diagram of the test setup for accomplishing the method of testing a vehicle audio system as according to the invention.

Referring now to FIG. 2, the components used for facilitating the method of testing the vehicle audio system using a composite signal 10 are illustrated. As shown, a vehicle V disposed with an audio system comprised of a radio, left front and rear drivers, and right front and rear drivers is disposed with at least one audio detection device for receiving the audio output signals from the vehicle drivers. Preferably, for convenience and efficiency a microphone is used as the detection device and most preferably a first microphone 12 is disposed near the front of the test vehicle V and a second microphone 14 is disposed near the rear of the vehicle. In this manner, signals emanating from a front driver are first received by the first microphone 12 and then the second microphone 14, and conversely, signals emanating from the rear drivers are first detected by the second microphone 14 and then by the first microphone 12. As such, speed of sound principles may be used as a means of determining a presence or performance of a speaker and/or driver as will be described in detail below.

A computer 16 is in communication with the first and second microphones 12 and 14 for receiving the detected audio signals for decoding and capturing the performance characteristics of each driver of the driver group during testing. The computer 16 also is provided for controlling an RF generator 18 such that the audio test signal being broadcast to the vehicle during testing is varied over time with respect to frequency and composition. A broadcast antenna 20 is in communication with the RF generator for communicating the generated signals to the vehicle radio. Accordingly, no direct connections between the test equipment and the vehicle audio system is required as with conventional methods which rely on remotely controlling radio parameters during testing via the diagnostic link to the vehicle data bus.

Referring again to FIG. 1 and at 120, after establishing performance baselines and equipment setup including presetting the audio system parameters as described above, the computer controlled RF generator 18 is used to broadcast an RF signal to the vehicle antenna for exciting at least one system speaker or driver. The broadcast signal may be sent to the vehicle in monotone, stereo left or stereo right for driving the various drivers. Preferably, the RF generator is controlled to first only excite the left front and rear drivers and then only the right front and rear drivers in stereo left and stereo right composite signal broadcasts to evaluate the response of each driver within a driver group.

The broadcast signal is preferably varied throughout the entire audio range from 120 Hz to 17 kHz for evaluating the frequency response of each driver. It is appreciated that the vehicle radio receives the broadcast signal and performs signal processing whereby an incoming composite broadcast signal is decoded such that a stereo left component of the signal will be output to the left front and left rear drivers while a stereo right component will be output to the right front and right rear drivers accordingly. Illustratively, if the RF generator is used to only broadcast a left stereo composite signal to the radio then the decoding process will only output the signal to the left front and rear drivers. Conversely, if the broadcast signal only contains a stereo right component, then the radio will output the appropriate signal to the right front and rear drivers. In this manner, the broadcast signal is used to select particular drivers within the driver group for evaluation rather than having to adjust the radio parameters using fade/balance control as according to conventional methods for audio system driver evaluation.

Next at 130, the first and second microphones being disposed in the vehicle passenger compartment adjacent the front and rear of the compartment, respectively, are used to detect the output from each of the system drivers in response to the broadcast signal. Illustratively, when a stereo left signal is broadcast to the vehicle the first microphone adjacent the front of the vehicle will receive an output from the left front driver first and then detect an output from the left rear driver. Conversely, the second microphone disposed near the rear of the vehicle will receive an output first from the left rear driver and then shortly thereafter the left front driver. The delay in time between the detection of outputs from the front and rear drivers can be determined by using the equation to calculate velocity wherein the velocity and the distance between each microphone and the audio system drivers remains constant.

As an example, if the distance between the first and second microphones is two meters with respect to the front and rear drivers, then by using the velocity equation, velocity=distance×time, it can be determined that a signal output from a front driver will be received by the first microphone approximately 6 milliseconds before being received by the second microphone wherein the speed of sound is approximately 332 meters per second. In this fashion, one can determine by broadcasting a stereo left signal only whether or not the left front and rear drivers are operating accordingly. Similarly, the performance of the right front and rear drivers can be evaluated by broadcasting a stereo right signal. Accordingly, when a stereo left signal is broadcast from the RF generator 18, the first microphone 12 should detect a frequency response from the left front driver, and approximately 6 milliseconds later, receive a frequency response from the left rear driver. These detected signals will be compared to the baselines for the left front and rear drivers with respect to arrival time, frequency response, and amplitude. If one driver in the group fails to respond during the sampling period, then it can be determined by the absence of the frequency response curves for the particular sampling period.

Next, at 140 the detected outputs are decoded and analyzed with respect to the baseline performance to determine if the system drivers are operating within predetermined parameters with respect to the baseline performances. At 150 if all of the system drivers have not been tested, then the computer controlled RF generator is adjusted to broadcast an RF signal operative to excite the remaining drivers within the driver group until the performance of all the system drivers has been evaluated.

When two microphones are used to detect the output from the drivers as described above, the first microphone may be turned off while the second microphone is on and vice versa, or they may both be on simultaneously to capture the outputs from the respective drivers being excited.

From the foregoing a method for evaluating the driver performance of a vehicle's audio system is provided which obviates the need for controlling the audio system parameters during the evaluating testing either manually or remotely via the vehicle data bus. Accordingly, the present invention operates to provide a reliable and efficient means for evaluating the performance of the vehicle's audio system drivers with reduced complexity, time and cost. Although the invention has been described with respect to certain illustrations, modifications thereto may become apparent to one skilled in the art without deviation from the spirit of the invention as defined by the scope of the appended claims.

We claim:

1. A method for determining the performance of a vehicle's audio system drivers in relation to predetermined baselines, the system drivers including left front and rear, and right front and rear drivers, said method comprising the steps of:

establishing a predetermined baseline for each of the system drivers by sampling a plurality of sampling drivers of the same type of each of the system drivers;

presetting the vehicle's audio system to a predetermined station;

presetting audio system output to a predetermined balance position and a predetermined center position;

broadcasting an RF signal for each of said system drivers;

maintaining the balance and center functions at the predetermined balance and predetermined center positions through the broadcasting;

detecting an output from each of the system drivers;

decoding the detected output from the system drivers; and analyzing the output with respect to the baseline performance to determine the performance of each of the system drivers.

2. The method of claim 1 wherein the broadcast signal is operative to first only excite the left front and rear drivers and then only excite the right front and rear drivers.

3. The method of claim 1 wherein said RF signal is provided by a computer controlled RF generator.

4. The method of claim 3 wherein said RF signal is varied over time from 120 Hz to 17 kHz.

5. The method of claim 1 wherein at least one microphone is used to detect said response from the system drivers.

6. The method of claim 1 further comprising disposing a first microphone near the front of the vehicle, and a second microphone near the rear of the vehicle.

7. The method of claim 6 wherein analyzing the output includes comparing timelines relative to when the outputs from the system drivers were detected by the first and second microphones to timelines of the predetermined baselines.

8. The method of claim 7 wherein the first microphone is turned off when the second microphone is turned on.

9. A method for determining the performance of a vehicle's audio system drivers in relation to predetermined baselines, the system drivers including left front and rear drivers, and right front and rear drivers, said method comprising the steps of:

establishing a baseline performance;

presetting the vehicle's audio system to a predetermined station;

presetting an audio system output to a predetermined balance position and a predetermined center position;

broadcasting an RF signal for exciting said system drivers;

maintaining the predetermined balance position and predetermined center position during the broadcasting;

detecting an output from the system drivers wherein a first microphone is disposed near the front of the vehicle, and a second microphone is disposed near the rear of the vehicle;

decoding the output from the system drivers; and analyzing the output with respect to the baseline performance to determine the performance of each of the system drivers.

10. The method of claim 9 wherein said broadcast signal is operative to first only excite the left front and rear drivers and then only excite the right front and rear drivers.

11. The method of claim 10 wherein analyzing the output includes comparing timelines relative to when the outputs from the system drivers were detected by the first and second microphones to timelines of the predetermined baselines.

12. The method of claim 9 wherein said RF signal is provided by a computer controlled RF generator.

13. The method of claim 12 wherein said RF signal is varied over time from 120 Hz to 17 kHz.

14. A method for determining the performance of a vehicle's audio system drivers in relation to predetermined baselines, the system drivers including left front and rear drivers, and right front and rear drivers, said method comprising the steps of:

establishing a predetermined baseline for each of the drivers by sampling a plurality of sampling drivers of the same type of each of the system drivers;

presetting the vehicle's audio system to a predetermined station;

presetting audio system output to a predetermined center position;

disposing a first microphone near the front of the vehicle and a second microphone near the rear of the vehicle;

first broadcasting a composite signal operative to only excite said right front and rear system drivers and then broadcasting a composite signal operative to only excite said left front and rear system drivers;

maintaining the balance and the center functions at the predetermined balance and the predetermined center positions during broadcasting;

detecting an output from each of the system drivers using the first and second microphones;

decoding the output from the system drivers; and analyzing the output from the system drivers with respect to the predetermined baselines to determine the performance of each of the system drivers.

* * * * *